US006003205A

United States Patent [19]

Dehaven

[11] Patent Number: 6,003,205

[45] Date of Patent: Dec. 21, 1999

[54] BEVERAGE BOTTLE HANDLE ATTACHMENT

[76] Inventor: William J. Dehaven, 1608 Edgehill Rd., Abington, Pa. 19001

[21] Appl. No.: 09/082,690

[22] Filed: May 21, 1998

[51] Int. Cl.[6] ..... A47B 95/02

[52] U.S. Cl. ..... 16/425; 294/29; 294/170; 220/759; 16/422

[58] Field of Search ..... 16/422, 425, 443, 16/444; 294/170, 159, 29, 27.1, 31.2; 220/758, 759, 768, 769

[56] References Cited

U.S. PATENT DOCUMENTS

| | | | |
|---|---|---|---|
| 2,029,051 | 1/1936 | Blevins | 294/170 |
| 2,981,562 | 4/1961 | Long | 294/170 |
| 3,717,288 | 2/1973 | Schlegel | 16/425 |
| 4,486,043 | 12/1984 | Rais | 294/31.2 |
| 4,842,158 | 6/1989 | Reyes, Jr. | 220/94 R |
| 4,896,913 | 1/1990 | Kennedy | 294/31.2 |
| 5,096,246 | 3/1992 | Cnare | 294/159 |
| 5,413,231 | 5/1995 | Carroll et al. | 220/759 |
| 5,580,343 | 12/1996 | Cafiero | 220/759 |

*Primary Examiner*—Chuck Y. Mah

[57] ABSTRACT

A new beverage bottle handle attachment for easy holding of a beverage bottle, in particular a two liter beverage bottle. The inventive device includes a top cap defining a top cavity adapted for receiving a top of a bottle therein. The top cap has an opening of the top cap adapted for extending a top spout of a bottle received by the top cavity. An elongate handle strap is extended from the peripheral edge of the top cap. The handle strap has a keyhole slot therethrough located towards the free end of the handle strap. A bottom cap defines a bottom cavity adapted for receiving the bottom of a bottle therein. A slide tab is extended from the side wall of the bottom cap. The slide tab is inserted through the keyhole slot of the handle strap to link the top cap to the bottom cap.

7 Claims, 3 Drawing Sheets

BEVERAGE BOTTLE HANDLE ATTACHMENT

BACKGROUND OF THE INVENTION

1. Field of the Invention

The present invention relates to accessories for beverage bottles and more particularly pertains to a new beverage bottle handle attachment for easy holding of a beverage bottle, in particular a two liter beverage bottle.

2. Description of the Prior Art

The use of accessories for beverage bottles is known in the prior art. More specifically, accessories for beverage bottles heretofore devised and utilized are known to consist basically of familiar, expected and obvious structural configurations, notwithstanding the myriad of designs encompassed by the crowded prior art which have been developed for the fulfillment of countless objectives and requirements.

Known prior art accessories for beverage bottles include U.S. Pat. No. 4,486,043; U.S. Pat. No. 4,660,876; U.S. Pat. No. 1,825,897; U.S. Pat. No. 4,379,578; U.S. Pat. No. 4,896,913; and U.S. Pat. No. 2,981,562.

While these devices fulfill their respective, particular objectives and requirements, the aforementioned patents do not disclose a new beverage bottle handle attachment. The inventive device includes a top cap defining a top cavity adapted for receiving a top of a bottle therein. The top cap has an opening of the top cap adapted for extending a top spout of a bottle received by the top cavity. An elongate handle strap is extended from the peripheral edge of the top cap. The handle strap has a keyhole slot therethrough located towards the free end of the handle strap. A bottom cap defines a bottom cavity adapted for receiving the bottom of a bottle therein. A slide tab is extended from the side wall of the bottom cap. The slide tab is inserted through the keyhole slot of the handle strap to link the top cap to the bottom cap.

In these respects, the beverage bottle handle attachment according to the present invention substantially departs from the conventional concepts and designs of the prior art, and in so doing provides an apparatus primarily developed for the purpose of easy holding of a beverage bottle, in particular a two liter beverage bottle.

SUMMARY OF THE INVENTION

In view of the foregoing disadvantages inherent in the known types of accessories for beverage bottles now present in the prior art, the present invention provides a new beverage bottle handle attachment construction wherein the same can be utilized for easy holding of a beverage bottle, in particular a two liter beverage bottle.

The general purpose of the present invention, which will be described subsequently in greater detail, is to provide a new beverage bottle handle attachment apparatus and method which has many of the advantages of the accessories for beverage bottles mentioned heretofore and many novel features that result in a new beverage bottle handle attachment which is not anticipated, rendered obvious, suggested, or even implied by any of the prior art accessories for beverage bottles, either alone or in any combination thereof.

To attain this, the present invention generally comprises a top cap defining a top cavity adapted for receiving a top of a bottle therein. The top cap has an opening of the top cap adapted for extending a top spout of a bottle received by the top cavity. An elongate handle strap is extended from the peripheral edge of the top cap. The handle strap has a keyhole slot therethrough located towards the free end of the handle strap. A bottom cap defines a bottom cavity adapted for receiving the bottom of a bottle therein. A slide tab is extended from the side wall of the bottom cap. The slide tab is inserted through the keyhole slot of the handle strap to link the top cap to the bottom cap.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new beverage bottle handle attachment apparatus and method which has many of the advantages of the accessories for beverage bottles mentioned heretofore and many novel features that result in a new beverage bottle handle attachment which is not anticipated, rendered obvious, suggested, or even implied by any of the prior art accessories for beverage bottles, either alone or in any combination thereof.

It is another object of the present invention to provide a new beverage bottle handle attachment which may be easily and efficiently manufactured and marketed.

It is a further object of the present invention to provide a new beverage bottle handle attachment which is of a durable and reliable construction.

An even further object of the present invention is to provide a new beverage bottle handle attachment which is susceptible of a low cost of manufacture with regard to both materials and labor, and which accordingly is then susceptible of low prices of sale to the consuming public, thereby making such beverage bottle handle attachment economically available to the buying public.

Still yet another object of the present invention is to provide a new beverage bottle handle attachment which provides in the apparatuses and methods of the prior art some of the advantages thereof, while simultaneously overcoming some of the disadvantages normally associated therewith.

Still another object of the present invention is to provide a new beverage bottle handle attachment for easy holding of a beverage bottle, in particular a two liter beverage bottle.

Yet another object of the present invention is to provide a new beverage bottle handle attachment which includes a top cap defining a top cavity adapted for receiving a top of a bottle therein. The top cap has an opening of the top cap adapted for extending a top spout of a bottle received by the top cavity. An elongate handle strap is extended from the peripheral edge of the top cap. The handle strap has a keyhole slot therethrough located towards the free end of the handle strap. A bottom cap defines a bottom cavity adapted for receiving the bottom of a bottle therein. A slide tab is extended from the side wall of the bottom cap. The slide tab is inserted through the keyhole slot of the handle strap to link the top cap to the bottom cap.

Still yet another object of the present invention is to provide a new beverage bottle handle attachment that provides a convenient handle for easy pouring of a beverage bottle.

Even still another object of the present invention is to provide a new beverage bottle handle attachment that the handle may be flattened against the side of a beverage bottle when not in use so that the handle attachment does not take up additional storage space.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
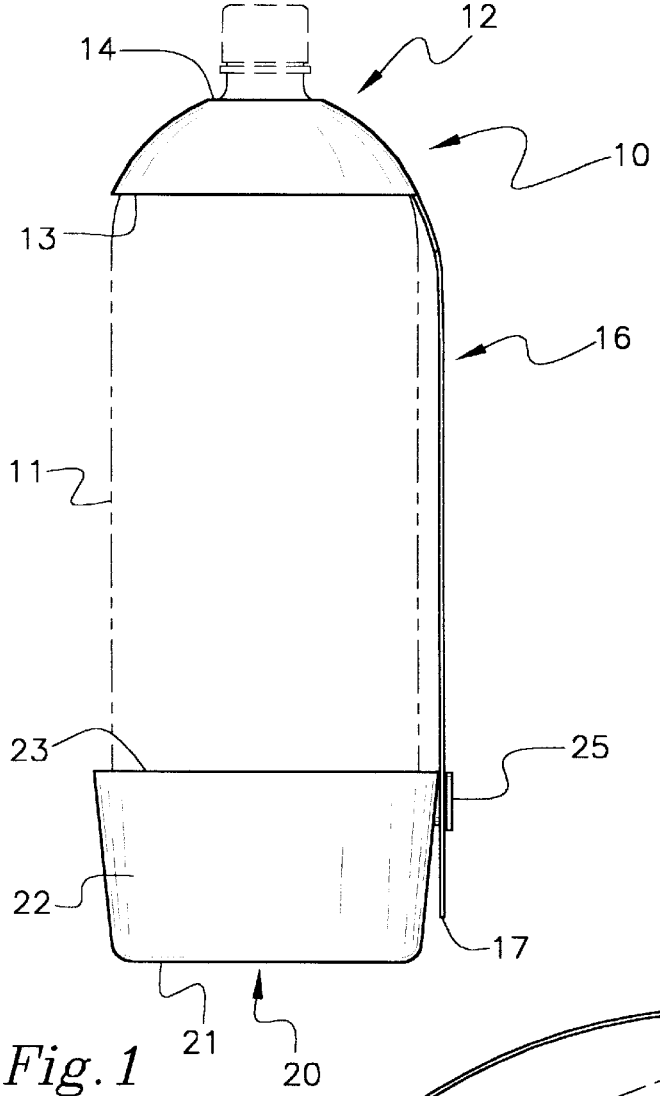
FIG. 1 is a schematic side view of a new beverage bottle handle attachment in use holding a bottle according to the present invention.

With reference now to the drawings, and in particular to FIGS. 1 through 6 thereof, a new beverage bottle handle attachment embodying the principles and concepts of the present invention and generally designated by the reference numeral 10 will be described.

In use, the handle attachment 10 is designed for attaching to a bottle 11. In particular, a two-liter beverage bottle having a top spout, a side, and a bottom that may include a plurality of radial grooves arranged along the vertices of a pentagon on the bottom of the bottle. As best illustrated in FIGS. 1 through 6, the beverage bottle handle attachment 10 generally comprises a top cap 12 defining a top cavity adapted for receiving a top of a bottle 11 therein. The top cap 12 has an opening 14 of the top cap 12 adapted for extending a top spout of a bottle 11 received by the top cavity. An elongate handle strap 16 is extended from the peripheral edge 13 of the top cap 12. The handle strap 16 has a keyhole slot 19 therethrough located towards the free end 17 of the handle strap 16. A bottom cap 20 defines a bottom cavity adapted for receiving the bottom of a bottle 11 therein. A slide tab 25 is extended from the side wall 22 of the bottom cap 20. The slide tab 25 is inserted through the keyhole slot 19 of the handle strap 16 to link the top cap 12 to the bottom cap 20.

In closer detail, the top cap 12 is generally dome-shaped and has a peripheral edge 13 and an opening 14 therethrough. The opening 14 of the top cap 12 is generally circular and is preferably centrally positioned on the top cap 12. The top cap 12 defines a top cavity adapted for receiving a top of a bottle 11 therein. The opening 14 of the top cap 12 is adapted for extending a top spout of a bottle 11 received by the top cavity.

The elongate handle strap 16 is extended from the peripheral edge 13 of the top cap 12. The handle strap 16 has a root and a free end 17 distal the peripheral edge 13 of the top cap 12. The root of the handle strap 16 is positioned adjacent the peripheral edge 13 of the top cap 12. Preferably, the longitudinal axis of the handle strap 16 is extended substantially perpendicular to a plane in which the peripheral edge 13 of the top cap 12 lies. In a preferred embodiment, the handle strap 16 has a generally triangular reinforcing portion 18 located at the root of the handle strap 16. Ideally, the free end 17 of the handle strap 16 is rounded. The handle strap 16 also has a keyhole slot 19 therethrough located towards the free end 17 of the handle strap 16. The keyhole slot 19 has generally circular portion and an elongate portion which extends from the circular portion towards the free end 17 of the handle strap 16.

The bottom cap 20 has a generally circular base 21 and a side wall 22 extending around the periphery of the base 21 of the bottom cap 20. Together, the base 21 and side wall 22 of the bottom cap 20 define a bottom cavity adapted for receiving the bottom of a bottle 11 therein. Preferably, the base 21 of the bottom cap 20 has a pair of spaced apart radial ridges 24 extending therefrom. The lengths of the radial ridges 24 are preferably extended at an acute angle with respect to each other so that the radial ridges 24 are located at adjacent points of a five point star superimposed and centered on the base 21 of the bottom cap 20. The radial ridges 24 are adapted for insertion into corresponding grooves in the bottom of a bottle 11 received in the bottom cavity. The radial ridges 24 help hold the bottom of the bottle 11 in place in the bottom cap 20.

The side wall 22 of the bottom cap 20 has a perimeter edge 23 distal the base 21 of the bottom cap 20. The slide tab 25 is extended from the side wall 22 of the bottom cap 20 and is preferably positioned adjacent the perimeter edge 23 of the side wall 22. The slide tab 25 has a head portion and a stem portion. The stem portion is interposed between the head portion and the side wall 22 of the bottom cap 20. As illustrated in the Figures, preferably, the head portion has a width (or diameter) greater than the stem portion. The slide tab 25 is inserted through the keyhole slot 19 of the handle strap 16 to form a handle loop with the handle strap 16 for a bottle 11 received by the top and bottom caps 12,20. This also links the top cap to the bottom cap so that a bottle received by the caps is held between the top and bottom caps.

Figure 2:
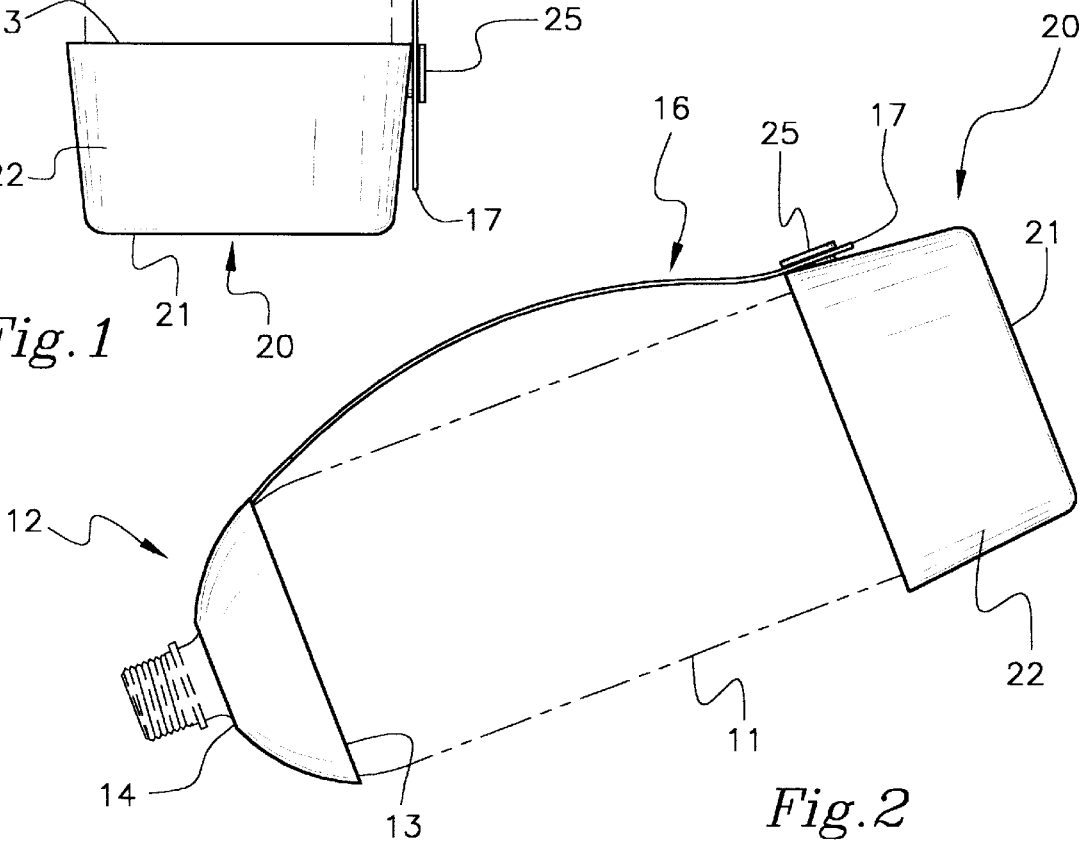
FIG. 2 is a schematic side view of the present invention holding a bottle with the handle strap being pulled away from the side of the bottle to form a hand space for extending a portion of a user's hand therethrough.
Figure 3:
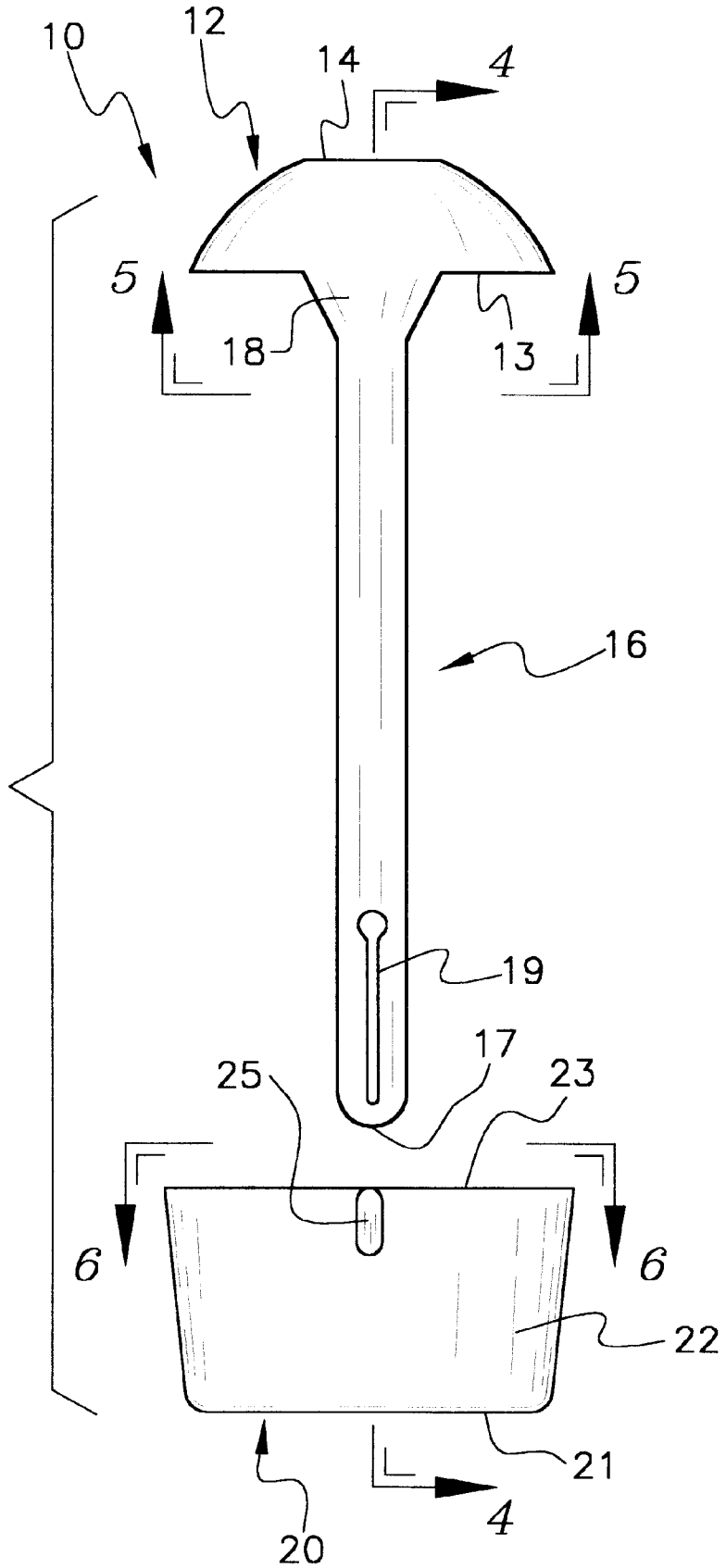
FIG. 3 is a schematic side view of the present invention with the handle strap detached from the bottom cap.
Figure 4:
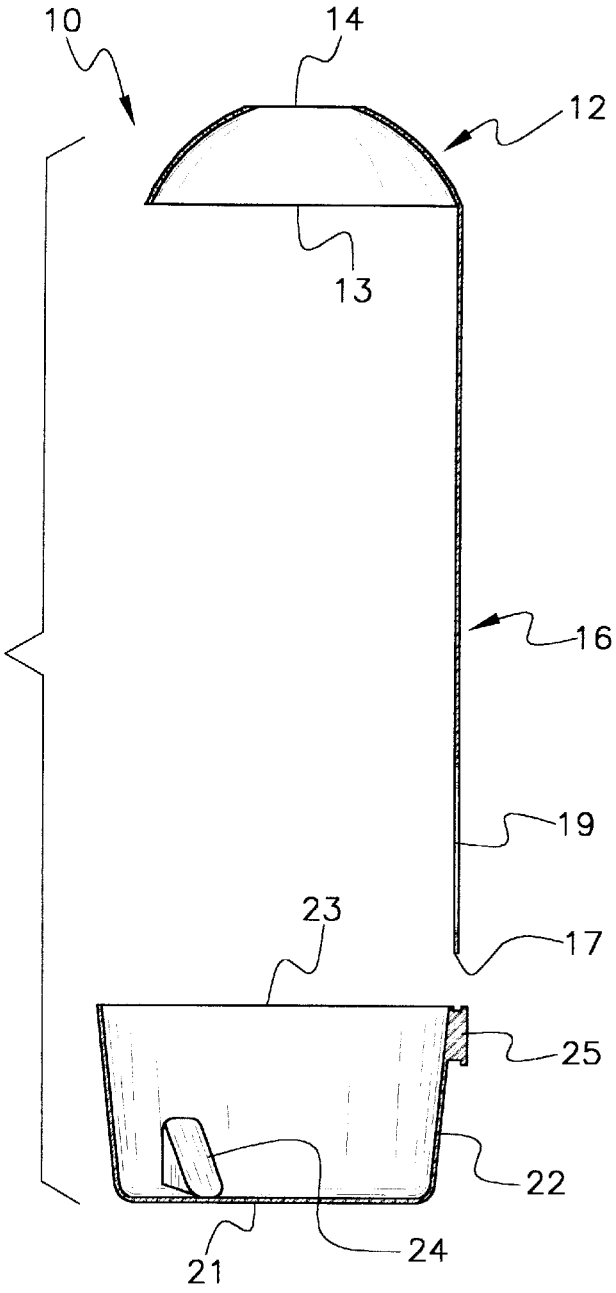
FIG. 4 is a schematic cross sectional view of the present invention taken from line 4—4 of FIG. 3.
Figure 5:
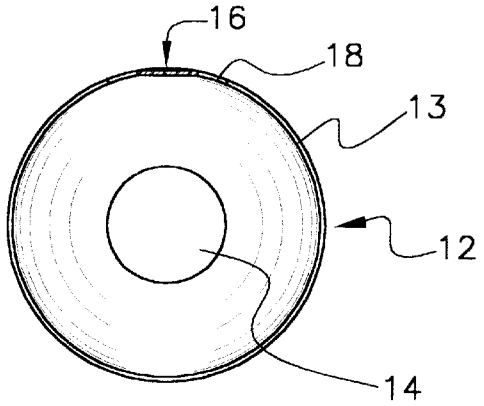
FIG. 5 is a schematic sectional view of the top cap of the present invention as seen from line 5—5 of FIG. 3.
Figure 6:
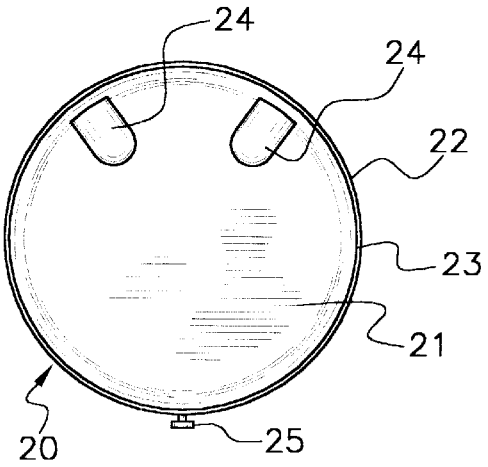
FIG. 6 is a schematic side view of the bottom cap of the present invention as seen from the vantage of line 6—6 of FIG. 3.

As illustrated in FIG. 2, the handle loop forms a space for extending the fingers of hand of a user therethrough. The slid tab is slidable along the length of the keyhole slot 19 to that the space formed between the handle strap 16 and the side of the bottle 11 is adjustable. With reference to FIG. 1, this permits positioning of the handle strap 16 flush with the side of the bottle 11 so that it takes up less space during storage of the bottle 11. In use, a user can grasp the handle strap 16 to hold a bottle held between the top and bottom caps. Additionally, a user can extend a hand through the space formed by the handle strap 16 with the palm resting against the side of the bottle 11.

In an illustrative ideal embodiment, the top cap 12 has a diameter defined by the peripheral edge 13 of the top cap 12 of less than about 4 inches and the opening 14 of the top cap 12 has a diameter of less than about 1 inch. In this illustrative embodiment, the handle strap 16 has a length of less than about 10 inches and a width of less than about ¾ inch. Ideally, the keyhole slot 19 has a length of less than about 2 inches. In this embodiment, ideally the bottom cap 20 has a length defined between the base 21 and the perimeter edge 23 of less than about 2 ½ inches and a diameter defined by the perimeter edge 23 of less than about 4 ½ inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A handle attachment for a bottle, said handle attachment comprising:

a top cap having a peripheral edge and an opening therethrough;

said top cap defining a top cavity adapted for receiving a top of a bottle therein, said opening of said top cap being adapted for extending a top spout of a bottle received by said top cavity;

an elongate handle strap being extended from said peripheral edge of said top cap, said handle strap having a longitudinal axis, a root, and a free end;

said root of said handle strap being positioned adjacent said peripheral edge of said top cap;

said handle strap having a keyhole slot therethrough located towards said free end of said handle strap;

a bottom cap having a base and a side wall, said base and side wall of said bottom cap defining a bottom cavity adapted for receiving the bottom of a bottle therein;

said side wall of said bottom cap having a perimeter edge;

a slide tab being extended from said side wall of said bottom cap; and said slide tab being inserted through said keyhole slot of said handle strap.

2. The attachment of claim 1, wherein said longitudinal axis of said handle strap is extended substantially perpendicular to a plane in which said peripheral edge of said top cap lies.

3. The attachment of claim 1, wherein said handle strap has a generally triangular reinforcing portion located at said root of said handle strap.

4. The attachment of claim 1, wherein said keyhole slot having generally circular portion and an elongate portion extending from said circular portion towards said free end of said handle strap.

5. The attachment of claim 1, wherein said base of said bottom cap has a pair of spaced apart radial ridges extending therefrom, said radial ridges being adapted for insertion into corresponding grooves in the bottom of a bottle received in said bottom cavity.

6. The attachment of claim 1, wherein said slide tab has a head portion and a stem portion, said stem portion being interposed between said head portion and said side wall of said bottom cap.

7. A handle attachment for a bottle having a top spout, a side, and a bottom having a plurality of radial grooves, said handle attachment comprising:

a dome-shaped top cap having a peripheral edge and an opening therethrough, said opening of said top cap being generally circular and being centrally positioned on said top cap;

said top cap defining a top cavity adapted for receiving a top of a bottle therein, said opening of said top cap being adapted for extending a top spout of a bottle received by said top cavity;

an elongate handle strap being extended from said peripheral edge of said top cap, said handle strap having a longitudinal axis, a root, and a free end;

said longitudinal axis of said handle strap being extended substantially perpendicular to a plane in which said peripheral edge of said top cap lies;

said root of said handle strap being positioned adjacent said peripheral edge of said top cap, said handle strap having a generally triangular reinforcing portion located at said root of said handle strap;

said free end of said handle strap being rounded;

said handle strap having a keyhole slot therethrough located towards said free end of said handle strap, said keyhole slot having generally circular portion and an elongate portion extending from said circular portion towards said free end of said handle strap;

a bottom cap having a generally circular base and a side wall extending around said base of said bottom cap, said base and side wall of said bottom cap defining a bottom cavity adapted for receiving the bottom of a bottle therein;

said base of said bottom cap having a pair of spaced apart radial ridges extending therefrom, the lengths of said radial ridges being extended at an acute angle with respect to each other, said radial ridges being adapted for insertion into corresponding grooves in the bottom of a bottle received in said bottom cavity;

said side wall of said bottom cap having a perimeter edge;

a slide tab being extended from said side wall of said bottom cap, said slide tab being positioned adjacent said perimeter edge of said side wall of said bottom cap;

said slide tab having a head portion and a stem portion, said stem portion being interposed between said head portion and said side wall of said bottom cap; and said slide tab being inserted through said keyhole slot of said handle strap, said slid tab being slidable along the length of said keyhole slot.

* * * * *